US007082918B2

(12) United States Patent
Rozario et al.

(10) Patent No.: US 7,082,918 B2
(45) Date of Patent: Aug. 1, 2006

(54) OIL PRESSURE CONTROL SYSTEM AND METHOD FOR ENGINES WITH HYDRAULIC CYLINDER DEACTIVATION

(75) Inventors: Frederick J. Rozario, Fenton, MI (US); William C. Albertson, Clinton Township, MI (US); James B. Hicks, Shelby Township, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/802,196

(22) Filed: Mar. 17, 2004

(65) Prior Publication Data

US 2005/0045142 A1 Mar. 3, 2005

Related U.S. Application Data

(60) Provisional application No. 60/498,266, filed on Aug. 26, 2003.

(51) Int. Cl.
*F01M 1/00* (2006.01)

(52) U.S. Cl. ..... 123/196 R; 123/198 F

(58) Field of Classification Search ..... 123/196 R, 123/198 F, 90.16, 90.33, 90.34
See application file for complete search history.

(56) References Cited

U.S. PATENT DOCUMENTS

| | | | | |
|---|---|---|---|---|
| 4,729,349 | A * | 3/1988 | Sonoda et al. | 123/90.34 |
| 5,220,891 | A * | 6/1993 | Nakamura et al. | 123/90.16 |
| 5,915,348 | A * | 6/1999 | Scheidt et al. | 123/90.17 |
| 6,510,824 | B1 * | 1/2003 | Vorih et al. | 123/90.12 |
| 6,557,518 | B1 * | 5/2003 | Albertson et al. | 123/198 F |
| 6,782,855 | B1 * | 8/2004 | Albertson et al. | 123/90.33 |
| 6,860,250 | B1 * | 3/2005 | Plenzler et al. | 123/196 R |

* cited by examiner

*Primary Examiner*—Noah P. Kamen
*Assistant Examiner*—Hyder Ali
(74) *Attorney, Agent, or Firm*—Christopher DeVries

(57) ABSTRACT

An oil lubrication and control system, for an engine having cylinder deactivation switching lifters operated at the pressure of the full oil system, is provided with an auxiliary pressure relief valve which opens to control maximum oil pressure in the system whenever the engine speed and temperature conditions lie beyond the ability of the oil pump pressure control unit to maintain the maximum pressure limit. Addition of the auxiliary pressure relief valve allows extended operation of the switching lifters, which are limited by their construction to operation below a prescribed pressure limit. In a preferred embodiment, the auxiliary pressure relief valve is mounted in the engine crankcase in a bore connected directly with the main oil gallery to provide mounting and actuation of the auxiliary pressure relief valve with a minimum of modifications to the engine oil system design.

7 Claims, 3 Drawing Sheets

OIL PRESSURE CONTROL SYSTEM AND METHOD FOR ENGINES WITH HYDRAULIC CYLINDER DEACTIVATION

CROSS REFERENCE TO RELATED APPLICATIONS

This application claims the benefit of U.S. Provisional Application No. 60/498,266 filed Aug. 26, 2003.

TECHNICAL FIELD

This invention relates to a system and method for control of oil pressure in engines having cylinder deactivation hydraulic lifters.

BACKGROUND OF THE INVENTION

It is known in the art relating to engine cylinder deactivation to utilize so-called switching valve lifters responsive to an oil pressure signal to either maintain full operation of all the engine cylinders or deactivate the valves of cylinders having the switching lifters. This cuts out operation of these cylinders as a part of the engine power development process. Currently available switching lifters include a roller cam follower enclosing a hydraulic lash adjuster that is locked in place by a latch pin. When the lifter is in position to operate an associated engine valve, depression of the latch pin by an oil pressure signal allows the valve lifter to telescope within the follower body against the force of a lost motion spring. This allows the valve to remain closed and contribute to deactivation of the associated cylinder.

When the lifter latch pin is in the locked position, a small amount of lash is provided by the clearance hole around the pin. The pin is maintained in a relatively free condition in the hole by the force of a lost motion spring acting against oil pressure in the lash adjuster, which tends to remove lash from the valve actuating mechanism. Because of this, oil supply pressure to the lash adjuster must be maintained below a predetermined maximum pressure in order that the force of the lost motion spring will be adequate to maintain the latch pin in a position that allows unlatching and latching motions free from friction against the follower body. Excessive friction would prevent deactivation and reactivation motions of the latch pin. Accordingly, the cylinder deactivation mode of operation is normally disabled during operating conditions where the engine oil pressure is greater than the specified maximum value, since attempts to deactivate or reactivate the cylinders with excessive oil pressure could result in misoperation and resulting unsatisfactory operation of the engine cylinders.

Under most normal warmed up engine conditions, the system oil pressure fed to the lash adjusters is adequately controlled by an oil pressure relief valve or bypass valve, associated with the engine oil pump, which either recirculates excess oil flow or returns it to the sump in order to maintain a maximum desired oil pressure. However, in some conditions of intermediate engine oil temperatures lower than the normal operating maximum temperatures, high engine speeds may create engine oil system pressures from the engine driven oil pump which exceed the specified maximum pressure and thus prevent use of the cylinder deactivation feature.

SUMMARY OF THE INVENTION

The present invention provides a modification of the oil control system and operating method which utilizes an auxiliary pressure relief valve added at a convenient location in the oil delivery system and operative to limit the maximum oil pressure by discharging excess oil from the system. The auxiliary valve opens only when the oil pressure bypass associated with the oil pump is unable to handle the oil flow required for oil pressure control.

In a preferred embodiment, an auxiliary oil pressure relief valve is mounted in an opening of the cylinder block or crankcase which connects directly with the main oil gallery. Oil is delivered from the pump through the main oil gallery to the lifter galleries and main bearing oil feeds, as well as to control passages for the switching lifters. The auxiliary oil pressure relief valve operates only when the combination of engine speed and oil temperature would result in a condition of excessive oil pressure beyond the control point of the oil pump bypass. Then the auxiliary relief valve opens and discharges any excess oil flow into the engine oil crankcase so as to maintain the maximum oil system pressure below the pressure at which the deactivation hydraulic lifters would be required to be disabled. In this way, the operating range of the cylinder deactivation lifters is extended to higher engine operating speeds and lower operating oil temperatures, so that cylinder deactivation can be further utilized to provide improvements in vehicle fuel economy.

These and other features and advantages of the invention will be more fully understood from the following description of certain specific embodiments of the invention taken together with the accompanying drawings.

DESCRIPTION OF THE PREFERRED EMBODIMENT

Figure 1:
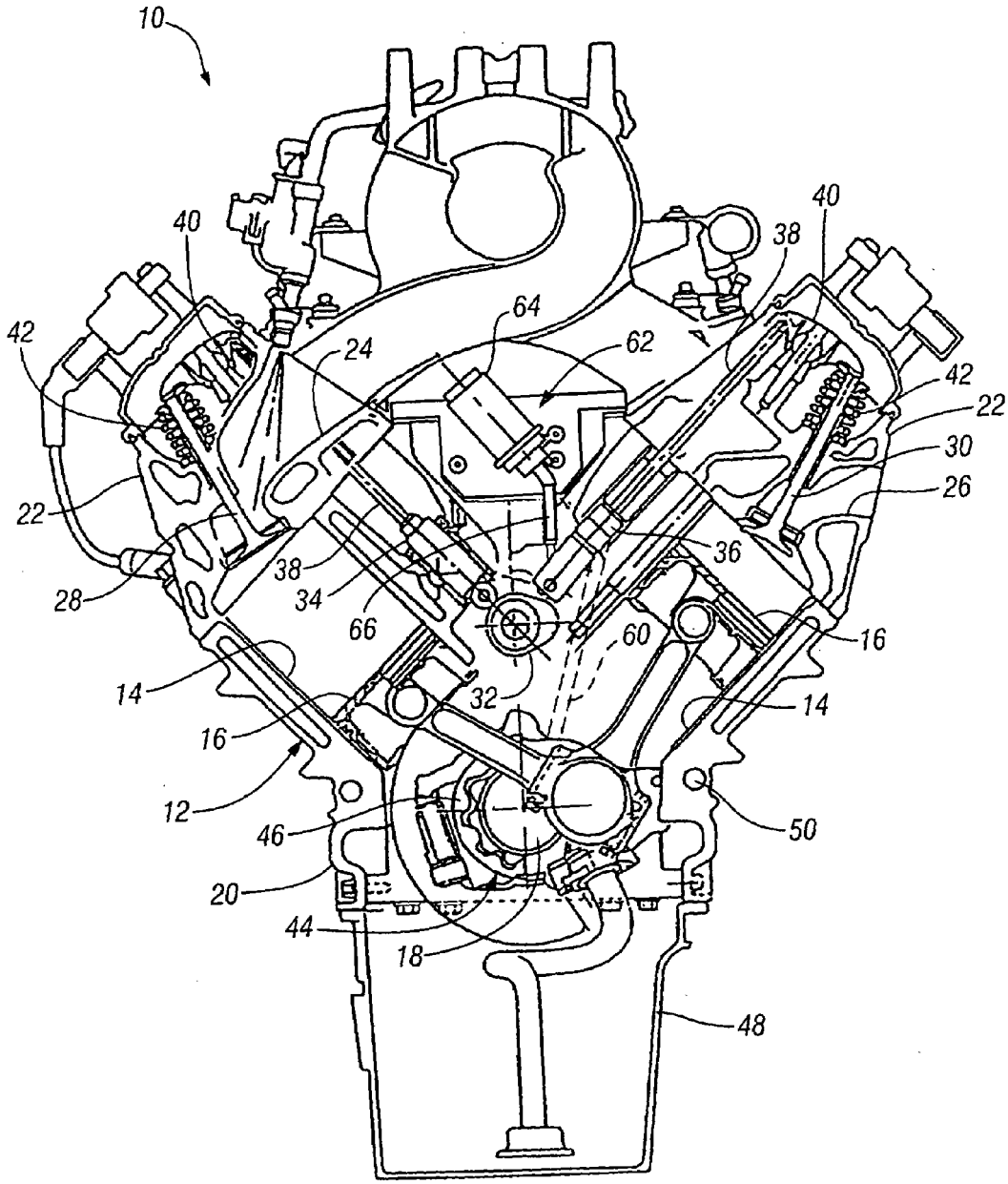
FIG. 1 is a cross-sectional view of a V8 automotive vehicle engine incorporating an oil pressure control system according to the present invention.

Referring first to FIG. 1 of the drawings, numeral 10 generally indicates a V8 automotive internal combustion engine. Engine 10 includes a cylinder block 12 having two banks of cylinders 14 containing pistons 16 reciprocated by rotation of a crankshaft 18 mounted in a crankcase portion 20 of the cylinder block 12. The cylinders are closed by cylinder heads 22 containing intake and exhaust passages 24, 26 controlled by intake and exhaust valves 28, 30, respectively.

The valves are actuated by valve gear including a camshaft 32 driven by the engine crankshaft 18. The camshaft 32 actuates valve lifters including, both conventional roller hydraulic lifters 34 and so called switching lifters 36. The lifters engage push rods 38 which connect with rocker arms 40 to actuate the valves 28, 30 against the force of valve springs 42.

The engine 10 includes an oil lubrication and control system 44 shown in FIGS. 1–4. The oil system includes an oil pump 46 driven directly by the crankshaft 18 and incorporating an internal oil pressure control valve. The oil pump draws oil from an oil pan 48 mounted below the crankcase portion 20 of the cylinder block.

Figure 2:
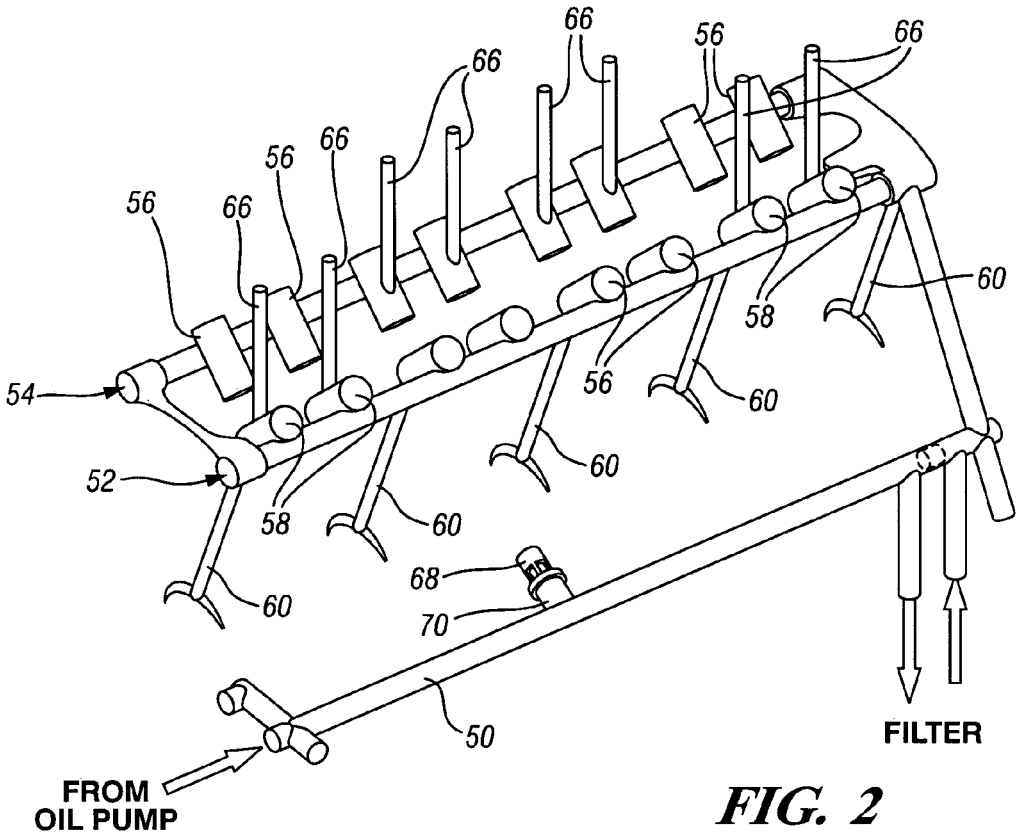
FIG. 2 is a pictorial view of the oil passages in a system of the invention.

As is shown in FIG. 2 of the drawings, the oil pump supplies pressurized oil to a main oil gallery 50. The main oil gallery supplies oil through an oil filter, not shown, directly to valve lifter oil galleries 52, 54 which in turn supply oil to the valve lifters 34, 36 (FIG. 1) for actuating their hydraulic lash adjusters, not shown. The lash adjuster oil feed goes to both conventional lifter bores 56 and the switching lifter bores 58. Lifter gallery 52 also supplies oil through runners 60 directly to the main bearings, not shown, of the engine.

As shown in FIG. 1, engine 10 also includes a solenoid control valve assembly 62 which receives pressurized oil from the oil system through internal passages, not shown. The valve assembly 62 includes a solenoid control valve 64 which controls the flow of oil from the oil system through feed passages 66 to the bores 58 of the switching lifters 36 as shown in FIGS. 1 and 2.

Figure 3:
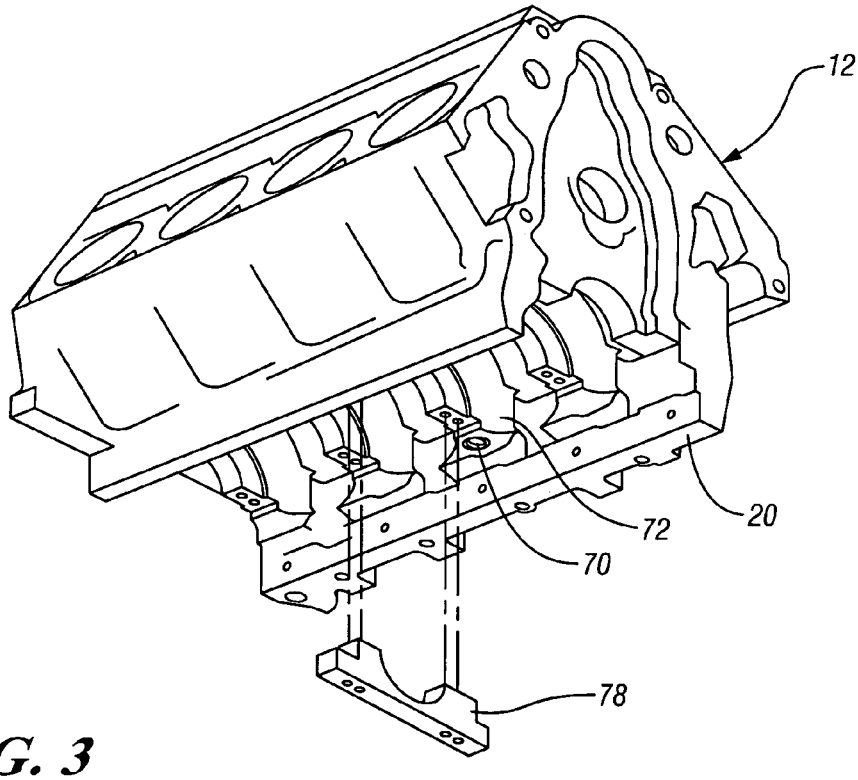
FIG. 3 is a pictorial view of an engine block similar to that of FIG. 1 and showing the location of a mounting hole for an auxiliary pressure relief valve.
Figure 4:
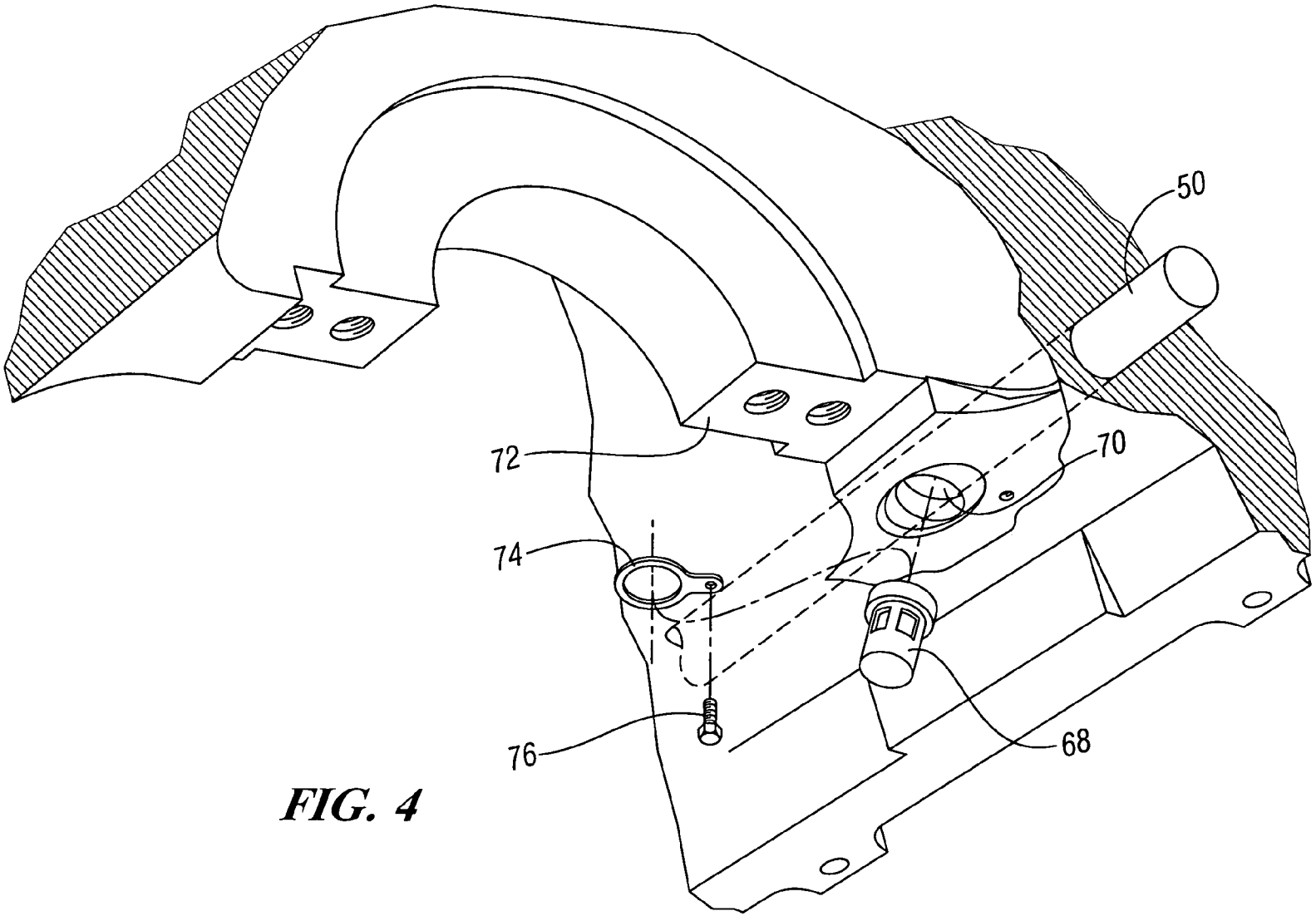
FIG. 4 is an enlarged pictorial view showing positioning of the pressure relief valve connected with the main oil gallery.

In accordance with the invention and as best shown in FIGS. 2–4, the oil system 44 also includes an auxiliary pressure relief valve 68. Valve 68 is mounted in a bore 70 formed in an engine crankcase portion 20 and connecting directly with the main oil gallery 50. The valve 68 is positioned adjacent a web 72 of the crankcase portion and is held in the bore 70 by a retainer 74 secured by a screw 76 or other suitable means. The auxiliary valve 68 lies adjacent a main bearing cap 78, provided with other bearing caps for supporting the main bearings of the crankshaft.

The location of the auxiliary pressure relief valve 68 in the oil system is selected in the illustrated embodiment because of its convenience to the main oil gallery 50 to provide connection of the valve to the gallery with the minimum amount of modification of the engine crankcase and cylinder block. However, in other engine arrangements, the valve could be located to connect with the main oil gallery or the lifter oil galleries or to another suitable location in the system which may be convenient.

In operation of the engine as described, motion of the pistons driven by combustion gases rotates the crankshaft 18 to deliver power from the engine. The crankshaft rotation drives the oil pump 46 to supply pressurized oil to the total lubrication and control system of the engine through the main oil gallery. The pressurized oil is utilized to lubricate the moving parts of the engine including the main and camshaft bearings, the lifters, rocker arms and other components. The pressurized oil is also utilized to actuate the lash adjusters carried within both sets of valve lifters 34, 36.

The same oil pressure is also supplied to the control valve assembly 62 and is delivered or cut off by the solenoid control valve 64 which controls oil pressure to the feed passages 66 leading to the switching lifter bores 58. For full cylinder operation, the oil pressure is cut off and the switching lifters remain locked in the operating position. When it is desired to deactivate the cylinders connected with the switching lifters, the solenoid valve is opened to pressurize the feed passages 66. The oil pressure unlatches lock pins in the lifter bodies, which allows the lifter bodies to telescope around their lash adjusters and thus disable operation of the valves connected with the switching lifters 36.

Because operation of the switching lifters requires oil pressure within a prescribed range, the lifters can only be actuated when the oil pressure is above a minimum which will actuate the lock pin and below a maximum pressure, above which the latch pin may fail to actuate properly. Generally, the engine oil pressure is controlled in the desired range by a pressure control valve, not shown, formed as part of the engine oil pump 46. However, under conditions of high engine speed and intermediate oil temperature less than the usual operating maximum temperature, the oil pump pressure control is inadequate to bypass sufficient oil to prevent the oil pressure from rising above the maximum at which the switching lifters cannot be actuated. For this reason, controls in the system are provided to prevent actuation of the switching lifters if the oil pressure rises above the predetermined pressure limit. This results in the inability to utilize the benefit of added fuel efficiency through operation of the engine on a reduced number of cylinders at times when the engine is operating at higher speeds and would benefit from operation in the cylinder deactivation mode.

In present invention, the auxiliary pressure relief valve connected to the main oil gallery 50 is calibrated to open if the oil pressure rises to near the maximum permitted level. The valve 68 then discharges sufficient oil from the main oil gallery to maintain the oil pressure below the established maximum. In this way, operation of the cylinder deactivation switching lifters may be extended into the conditions of high engine speed and moderate or intermediate oil temperature, thereby extending the fuel efficiency benefits of cylinder deactivation and increasing the overall fuel efficiency of the engine.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A system for control of oil pressure in combination with an engine having cylinder deactivation hydraulic lifters, the system comprising:

an oil pump driven by the engine and supplying pressurized oil from a main oil gallery to an oil gallery for lubricating selected engine components and controlling actuation of the cylinder deactivation valve lifters;

an oil pressure control associated with the oil pump and operative to control oil pressure supplied to the oil gallery under normal operating temperatures; and an auxiliary pressure relief valve in the system connected directly with the main oil gallery and operative to maintain oil pressures at high engine speeds and low oil temperatures below a maximum allowable pressure, thereby permitting actuation of the deactivation lifters.

2. A system as in claim 1 wherein the engine includes a cylinder block and the auxiliary pressure relief valve is mounted in and connected to a gallery in the cylinder block.

3. A system as in claim 2 wherein the auxiliary pressure relief valve is mounted in a crankcase portion of the cylinder block.

4. A method of extending the operating range of cylinder deactivation valve lifters in an engine oil system during operation of the engine at low oil temperatures and high speeds, the method comprising:

supplying pressurized oil to an oil gallery from an engine driven positive displacement oil pump for lubricating selected engine components and controlling actuation of the cylinder deactivation valve lifters;

limiting output of the pump by bypassing excess oil to control oil pressure supplied to the oil gallery under normal operating oil temperatures; and limiting pressure in the system at high engine speeds and low oil temperatures by opening an auxiliary pressure relief valve in the system connected directly to a main oil gallery and operative at reduced operating oil temperatures to maintain oil pressures below a maximum allowable pressure, thereby permitting actuation of the deactivation valve lifters.

5. A method as in claim 4 including mounting the auxiliary pressure relief valve in a portion of the engine containing the main gallery.

6. A method as in claim 5 wherein the auxiliary relief valve is located in the engine crankcase.

7. A method as in claim 6 wherein the auxiliary relief valve is mounted in a bore of a crankcase connected with the main gallery.

* * * * *